United States Patent [19]

Feuling

[11] Patent Number: 4,815,706

[45] Date of Patent: Mar. 28, 1989

[54] VALUES FOR IMPROVED FLUID FLOW THEREAROUND

[76] Inventor: James J. Feuling, 4035 N. Ventura Ave., Ventura, Calif. 93001

[21] Appl. No.: 144,097

[22] Filed: Jan. 15, 1988

[51] Int. Cl.[4] ..... F01L 3/00

[52] U.S. Cl. ..... 251/356; 123/188 AA

[58] Field of Search ..... 123/188 AA; 251/357, 251/356

[56] References Cited

U.S. PATENT DOCUMENTS

| | | | |
|---|---|---|---|
| 2,294,803 | 9/1942 | Rich | 123/188 AA |
| 2,394,177 | 2/1946 | Hoern | 123/188 AA |
| 2,593,740 | 4/1952 | Faust | 251/357 |
| 4,351,292 | 9/1982 | Worthen et al. | 123/188 AA |

*Primary Examiner*—A. Michael Chambers
*Attorney, Agent, or Firm*—Frank D. Gilliam

[57] ABSTRACT

Improved intake and exhaust valves for an engine or the like for more efficient fluid flow into a cylinder and the exhausting of spent fluid therefrom. The valves of the present invention have the same general configuration of the valves of a conventional internal combustion engine except that the vertical circumferential portion of the valve head (margin) is differently configured. A curvilinear (Coanda effect) surface is employed on the intake valve between the stem side edge of the margin portion of the valve head and the valve seat and a sharp 90 degree edge is formed at the joinder of the margin and valve face (Feuling effect). The exhaust valve employs the Coanda effect curved surface portion at both the joinder of the back surface of the valve and the valve seat as does the intake valve and further employs this curved surface at the joinder of the valve face and margin of an exhaust valve. In both the intake and exhaust valves the margin of the valve is substantially twice the length of the generally accepted maximum allowable length (Feuling effect). This increased vertical margin surface may be accomplished in several ways, namely, by an increased width valve head thickness with a recessed valve head face or an increased valve head thickness alone without the recess.

7 Claims, 1 Drawing Sheet

VALUES FOR IMPROVED FLUID FLOW THEREAROUND

BACKGROUND OF THE INVENTION

This invention is directed to engines and more particularly to improving fluid flow into and exhaust flow out of the engine cylinders.

It is known that as the air-fuel mass flowing through the intake port of a modern engine encounters the valve head, it is naturally formed into a path around the head. The flow dynamics, created when the rushing gaseous mass encounters the relatively large valve head and is pulled away from the valve stem, well above the valve head, and forces the gaseous mass to form a substantially cone-shaped umbrella around the valve head. Adjacent to the valve stem there is no flow whatsoever. The entire flow path is adjacent to the edge of the valve head.

As the gaseous mass moves past the rim of the valve, and flows into the cylinder it forms another cone downstream of the valve head.

Because of this phenomenon, it has been long known that the length of the gasious mass cone extending into the cylinder is of extremely short duration and accordingly must not be disturbed in any way. Maximum flow is achieved by undisturbed cone action below the valve head.

It is also well known that intake valve design contributes to the flow of the gasious mass into the cylinders. An ideal intake seat and valve face are shown in FIG. 1. The seats and faces must be concentric with a measured runout less of than 0.001 inch. The valve faces should terminate right on the very outer edge of the facing surface. The edges where the lead-in and top cuts meet the face or seat cuts must not be radiused. These edges should be sharply defined, for absolute maximum performance. Referring to the prior art shown in FIG. 1, the intake port A, cylinder head intake port B, intake valve C and combustion chamber D are shown. At location E a 60 degree bottom cut is made. At location F a 45 degree seat in the range of 0.030–0.060 inches is formed. At location G a 15 degree top cut is made. A radius is formed at location H which extends from the topcut to the margin. A 35 degree under cut is made on the edge of the underside of the valve C at location I. A 45 degree face edge is formed on the planar valve face at location J. The end margin or edge width of the valve at location L should be between 0.030–0.050 inches. The dimension of the valve stem M should be as small as physically allowable for valve stem operating integrity. A valve rim or margin width is taught to be no greater than 0.050 inches. With any increase from this maximum thickness believed to provide no improvement to gas flow while adding undesirable mass to the valve head.

It is apparently unknown in the present state of the art that in fact the ideal desired conic gas flow shape beneath the valve head along the cylinder walls extends only a short distance into the cylinder past the valve face and then almost immediately expands toward the center of the cylinder while gas on the inside of the cone adjacent to the margin clings to the valve edge surface and follows the topcut to the valve face surface creating eddies which produce undesirable turbulence along the valve face. This turbulence causes uneven distribution of gas within the cylinder resulting in inefficient combustion.

Ideally, the cone should extent well into the cylinder approaching the bottom thereof. The present intake valve configuration is directed to reducing the eddies and the resulting turbulence normally created along the valve face by extending the cone to a greater depth within the cylinder thereby producing a more efficient and cleaner burning of the combustible gas delivered to the cylinder.

An ideal exhaust valve is shown in FIG. 2 also identified as prior art. As can be seen in FIG. 2, the exhaust port M is similar to the intake port A except that the bottom cut E is replaced with a curvilinear wall N. The other elements remain substantially the same including the planar valve face. The exhaust valve is similar to the intake valve except that the under cut is eliminated and the margin is increased to a range of from 0.030–0.060 inches. The top cut L is maintained.

The gas flow from the cylinder during the exhaust cycle is similar to the intake gas flow except that the spent gas flows in the opposite direction. A similar cone of exhaust gas is formed as the exhaust gas passes around the valve edge and through the exhaust port between the margin and valve seat. Any turbulence to this gas flow decreases the efficiency of exhaust gas removal and results in engine inefficiency.

The prior art ideal exhaust valve has drawbacks that have been substantially overcome by this invention. The rectilinear bottom cut causes the exhaust gas flow to break away from the valve face at the topcut and margin joinder which creates eddies and resulting turbulence in the cone of exhaust gas passing between the valve seat and margin. The addition of a Coanda effect curvilinear edge between the valve face and margin, and the increased margin dimension, Feuling effect, of the present invention causes the exhaust gas to adhere and substantially follow the valve rim between the valve face and margin rather than break away therefrom as with the supposed ideal exhaust valve configuration. Turbulence and the resulting inefficient flow is thereby substantially eliminated providing an increase in engine efficiency.

There has not been any use of an extended margin for intake valves of an internal combustion engine used in combination with the Coanda effect between the bottom and margin of the valve or in exhausted valves the combination of the extended margin and Coanda effect between the bottom of the valve and the margin and between the face of the valve and margin until the emergence of this invention.

SUMMARY OF THE INVENTION

Applicant invention is directed to modifying the head configuration of both intake and exhaust valves of an internal combustion engine to improve the efficiency of the gas flow into the cylinders and exhaust gas flow from the cylinders by 5% to 15% over the prior art so called "ideal" valve head configuration. This improvement is accomplished on the intake valve by providing a curvilinear undercut surface between the valve bottom surface and the margin surface (Coanda effect) and providing a larger dimensioned valve head margin surface with a sharp 90 degree edge between the margin and face (Feuling effect). This new intake valve configuration causes the cone of combustible gas at the margin of the valve to extend well into the cylinder breaking away from the valve edge at the face and margin interface thereby substantially eliminating or at least minimizing the turbulence along the valve face.

This improvement is accomplished on the exhaust valve by providing a Coanda effect curvilinear edge between the valve face and margin so that the exhaust gas will follow the valve face around the curvilinerr edge through the margin with minimal break away from the valve and out the exhaust port and thereby substantially eliminating any normally expect turbulence in the gas flow through the exhaust valve port.

The increased margin dimension is provided generally by increasing the valve head thickness and then removing excess mass from the central portion of the valve face especially in high R.P.M. engines. In low R.P.M. engines it is not necessary that the excess mass be removed due to the slow relative action of the valves. It has also been found that if this excess mass when removed is cut away in the shape of a concave dome valve heat dissipation is improved, i.e. the valves runs cooler for any given fuel than the prior art valves. It has been further found that if this concave dome has leading surfaces from the valve face that are parallel with the margin still greater heat dissipation occurs, ie. hotter than normal burning fuels can be used in the engine and yet the valves will remain at a safe operating temperature. This is not possible with the present state of the art valves.

An object of this invention is to reduce the turbulence air fuel separation in a cylinder of an internal combustion engine that exists along the valve face in so called "ideal" intake gas and exhaust gas flow design.

Another object of this invention is to extend the cone of combustible gas entering a cylinder of an internal combustion a greater distance into the cylinder than possible with the current state of the art valve technology while substantially eliminating combustible gas adherence to the face of the valve.

Another object of this invention is to eliminate turbulence adjacent to the exhaust valve face by forming the transition between the valve face and margin so that the exhaust gas adheres to the valve face and margin as it flows out through the exhaust port.

Still another object of the invention is to provide both intake and exhaust valves with increased margin dimension with substantially the same mass as prior art "ideal" valves.

Yet another object of this invention is to provide an exhaust valve that can be made smaller than present exhaust valves for a given engine and yet provide optimum flow.

Yet still another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as the specification proceeds, the invention consists essentially in the arrangement and construction of parts all as hereinafter more particularly described, reference being had to the accompanying drawings in which:

BRIEF DESCRIPTION OF THE DRAWING FIGURES

DETAILED DESCRIPTION OF THE PREFERRED EMBODIMENT

It should be understood that even though, for ease of explanation, the following and above discussions are directed for use of the invention in an internal combustion engine enviornment, the invention can be employed in any enviornment where fluid flow is controlled by valve means.

Figure 3:
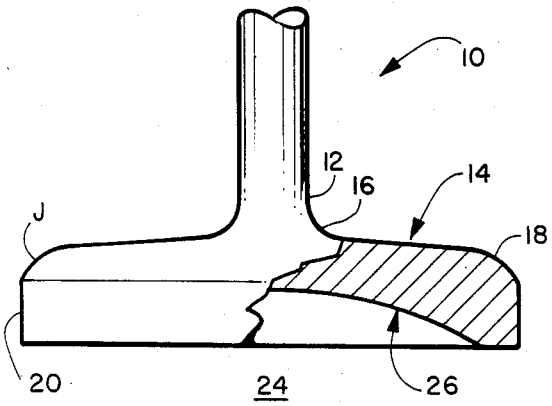
FIG. 3 is a schematic showing depicting one embodiment of an intake valve of the present invention.

Referring specifically to drawing FIG. 3, this Figure depicts the first embodiment of the invention. An intake valve 10 is shown. The top end of a valve stem 12 blends into the bottom surface of a valve head 14 through a curvilinear surface 16. This surface 16 provides a smooth curvilinear transition between the valve stem and valve head under surface. A curvilinear surface 18 extends from the outer edge of surface 16 to the valve rim or margin 20. This curved surface 18 causes the gas flow to be attached and guided or directed around the valve head with minimal break away from the valve surface and, therefore, minimal resulting disturbance to that flow, this is referred to as the Coanda effect. The valve margin 20 should extend a distance greater than 1/20th of the valve head diameter from the outer end of curve 18 to its termination at a sharp edge at the valve face. A substantially 90 degree valve margin of 1/15 of the diamter of the valve head appears to be an optimum dimension. This extended margin guides or directs the gas flow substantially perpendicular to the margin surface substantially in the form of a cylinder 22 past the valve head 14 and well into the cylinder 24 before dramatically flowing toward the center of the cylinder where it swirls and distributes the combustible gas throughout the cylinder in a substantially uniform manner.

The sharp edge at the valve face causes the flow which clings to the valve to make a clean break from the valve and continue downward toward the bottom of the cylinder, not shown.

In order to reduce the mass of the valve head 14 while providing the increased margin dimension, the valve head is made thicker with the center portion of the valve face having a recess 26 which provides a reduced valve head thickness in this region. As shown in the first embodiment of the valve of the present invention, the recess 26 is in the form of a curvilinear concave cutout which extends to the valve face surface and is slightly spaced from the margin edge along rectilinear valve face surface 28.

Figure 4:
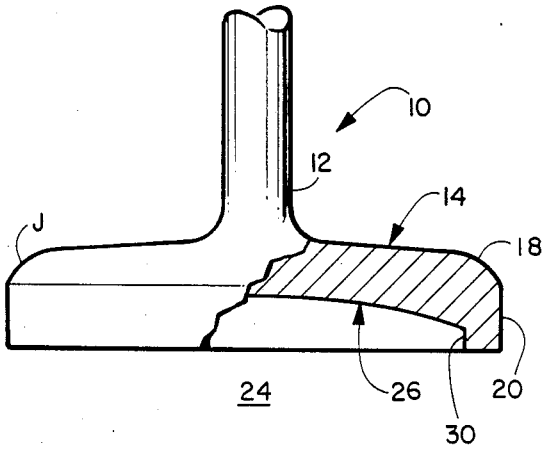
FIG. 4 is a schematic showing depicting a second embodiment of the intake valve of the present invention.

Referring now specifically to drawing FIG. 4, this Figure depicts a valve 10 similar to the showing in FIG. 3 except that the recess 26 does not extend to the valve face but terminates about above the face surface and is extended to the valve face via wall 30 which is parallel with margin 20.

Figure 1:
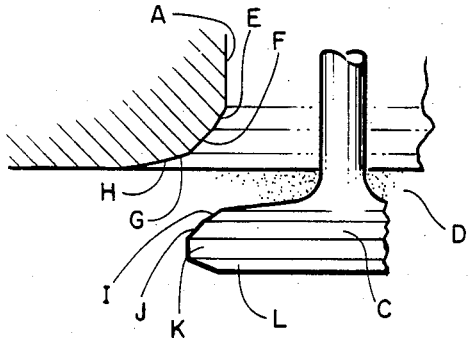
FIGURE 1 PRIOR ART
FIG. 1 is a schematic showing depicting the ideal design of an intake valve seat and valve configuration of the prior art.
Figure 2:
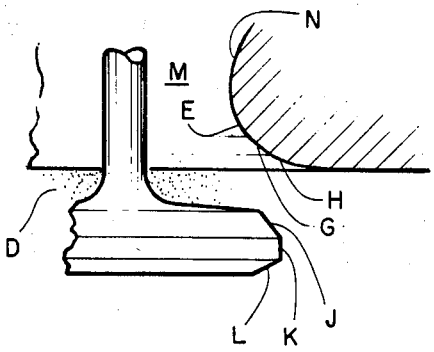
FIGURE 2 PRIOR ART
FIG. 2 is a prior art showing depicting the ideal design of an exhaust valve seat and valve configuration of the prior art.

It is believed that the recess configuration as shown in FIGS. 3 and 4 provides an increased cooling effect to the valve over the prior art valves of FIGS. 1 or 2.

Figure 5:
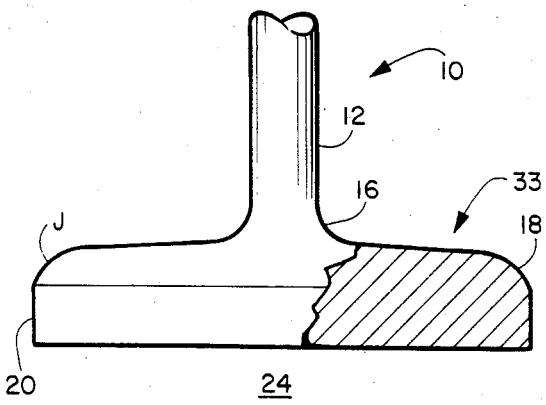
FIG. 5 is a schematic showing of a third embodiment of the intake valve of the present invention.

Referring now specifically to FIG. 5 an increased valve head thickness as shown could be employed if the cooling effects of either the FIGS. 3 and 4 recesses were not desired and the engine configuration would allow for the increased mass of the valve head, such as for example a low R.P.M. engine.

Figure 6:
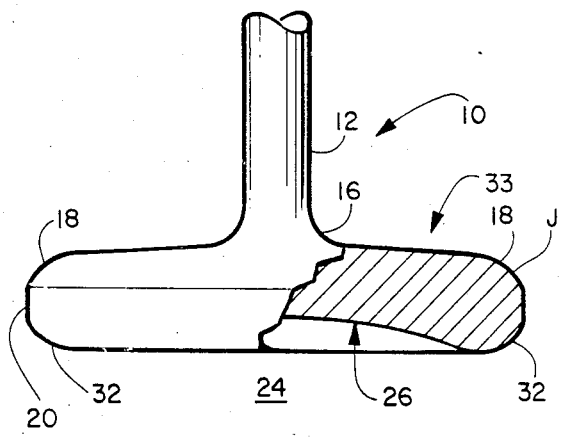
FIG. 6 is a schematic showing of a typical exhaust valve configuration according to the present invention.

Referring now specifically to FIG. 6, an exhaust valve 33 of the present invention is shown. This valve differs from the prior discussed art in that the topcut L as shown in FIG. 2 is replaced with a curvilinear edge 32 extending from the face to the margin which like in the intake valve provides for adherence of the exhaust gas to the valve as the gas makes a transition from the valve face to the exhaust port, thus reducing or eliminating turbulence to the gas flow along the valve face.

It should be understood that the description of the recesses on the face of the intake valve and their purpose and function apply equally as well to the exhaust valve even though two of the recess not shown as relating directly thereto.

Since various modifications can be made in the invention as hereinbefore described, and many apparently widely different embodiments of the same made within the spirit of and scope, it is intended that all matter contained in the accompanying specification shall be illustrative only and not in a limiting sense.

What is claimed is:

1. A valve for controlling fluid flow therearound and into a working cylinder comprising:

a stem;

a valve head having a face, a back and a margin surface, said margin surface being substantially perpendicular to the longitudinal center line of said stem with a length greater than 1/20th of said valve head diameter, said back being centrally attached to one end of said stem;

said valve head includes a valve seat located adjacent to said back surface of said valve head; and a curvilinear surface extends between said valve seat and said margin.

2. The invention as defined in claim 1 wherein the optimum length of the margin surface being 1/15th the diameter of said valve head.

3. The invention as defined in claim 1 further comprising a recess in the central portion of said valve face.

4. The invention as defined in claim 3 wherein said recess is concave and extends to the surface of said valve face.

5. The invention as defined in claim 3 where in said recess is curvilinear and includes walls extending from the face of said valve to the curvilinear recess, said walls are substantially parallel to said margin surface.

6. The invention as defined in claim 1 further comprising a rectangular substantially 90 degree sharp edge between said margin and said valve face.

7. The invention as defined in claim 1 further comprising a curvilinear interface between said margin and said valve face.

* * * * *